United States Patent [19]

Levine et al.

[11] 4,227,996

[45] Oct. 14, 1980

[54] FLOTATION PROCESS FOR IMPROVING RECOVERY OF PHOSPHATES FROM ORES

[75] Inventors: Nathan M. Levine; Walter Von Drathen, both of Louisville, Ky.

[73] Assignee: Celanese Corporation, New York, N.Y.

[21] Appl. No.: 22,656

[22] Filed: Mar. 22, 1979

[51] Int. Cl.[2] ..... B03B 7/00

[52] U.S. Cl. ..... 209/12; 209/166

[58] Field of Search ..... 209/166, 167; 252/61; 210/54

[56] References Cited

U.S. PATENT DOCUMENTS

| | | | |
|---|---|---|---|
| 2,278,060 | 3/1942 | Christman | 209/166 |
| 2,343,221 | 2/1944 | Maust | 209/166 |
| 2,384,825 | 9/1945 | Ellis | 209/166 |
| 2,611,485 | 9/1952 | Tveter | 209/166 |
| 2,708,666 | 5/1955 | Carpenter | 209/166 X |
| 2,818,976 | 1/1958 | Lentz | 209/166 |
| 2,914,173 | 11/1959 | Le Baron | 209/166 |
| 2,927,692 | 5/1960 | Hollingsworth | 209/167 |
| 3,088,590 | 5/1963 | Hoseman | 209/166 X |
| 3,114,704 | 12/1963 | Kauffman | 209/166 |
| 3,240,721 | 3/1966 | Fadse | 210/54 C |
| 3,251,852 | 5/1966 | De Grote | 209/166 X |
| 3,388,993 | 6/1968 | Dibble | 209/166 X |
| 3,782,539 | 1/1974 | Painter | 209/166 |

FOREIGN PATENT DOCUMENTS

| | | | |
|---|---|---|---|
| 1241821 | 8/1960 | France | 209/166 |
| 1015747 | 1/1966 | United Kingdom | 209/3 |

*Primary Examiner*—Robert Halper

*Attorney, Agent, or Firm*—Herbert P. Price; K. A. Genoni; T. J. Morgan

[57] ABSTRACT

A flotation process is provided for beneficiating phosphate ores in at least two floats after conditioning with 0.4–1.5 pound per ton of fuel oil and adding 0.025–0.1 pound per ton of a frother and 0.2–0.5 pound per ton of a polyamine cationic collector to remove silica in the froth (tails) and obtain 75–84% recoveries of phosphate in the concentrate (sink) which contains no more than about 6% insol. For some ores, the floats can be made on each fraction, after desliming thereof, which are obtained by screening over a 35 mesh screen. For other ores, desliming and a rougher flotation are initially needed. The silica froths (rougher tails) from this float are then cleaned and recleaned in separate floats, without additional conditioning or addition of collector to produce tails which are discarded and a combined sink which is screened over a 48 mesh screen to produce a +48 mesh fraction which is discarded and a −48 mesh fraction which is concentrate (product). Depending upon the ore, the sink from the first float is directly usable as product or is screened over a 35 mesh screen to produce a −35 mesh concentrate (product) and a +35 mesh fraction which is conditioned with fuel oil, treated with a frother and collector, and floated to produce a tails, which is discarded, and a third concentrate as product.

20 Claims, 2 Drawing Figures

FLOTATION PROCESS FOR IMPROVING RECOVERY OF PHOSPHATES FROM ORES

BACKGROUND OF THE INVENTION

1. Field of the Invention

This invention relates to the concentration of phosphate minerals from their ores and particularly relates to the beneficiation of phosphate ores by flotation of the silica particles therein.

2. Review of the Prior Art

In the Florida phosphate industry, the grades of calcium phosphate having as much as 35–40% bone phosphate of lime (BPL), $Ca_3(PO_4)_2$, are presently decreasing, particularly because ores containing coarse phosphate pebbles are diminishing in quantity and being replaced with ores containing finer phosphate particles having about the same size range as coarse sand.

About forty years ago, concentration methods were developed and extensively practiced for beneficiation of phosphate minerals in Florida and elsewhere by means of negative-ion or anionic agents for preferentially collecting the phosphate values in the ore by flotation thereof, but a considerable percentage of these values often went to waste with the tailings. In 1942, the Crago patent, U.S. Pat. No. 2,293,640, disclosed the use of a negative-ion agent to collect and remove from an ore a rougher concentrate containing a high proportion of the phosphate values mixed with some siliceous gangue and thereafter removing the negative-ion agent from this rougher concentrate and treating it with a positive-ion agent to collect and remove therefrom by froth flotation most of the siliceous gangue contained therein.

U.S. Pat. No. 2,313,360 shortly thereafter disclosed a method for preferentially floating the siliceous gangue from phosphate ores with primary aliphatic amines, such as octadecylamines at 1.25 pounds per ton of ore. This flotation, however, had to be conducted on the alkaline side, such as at pH values of about 8.5 to 10 or 11. Preferably, the ground ore was conditioned by contact with an alkaline solution for a few minutes, then washed with water to remove adhering alkali, and formed into a slurry having the desired pH.

U.S. Pat. No. 2,750,036 teaches a process for anionic conditioning with reagents including NaOH, fatty acids, and fuel oil, retarded flotation to remove a high grade froth phosphate product, again conditioning the underflow with anionic reagents, and scavenger flotation to produce a froth concentrate which is mixed with sulfuric acid, rinsed, and floated with positive-ion reagents to produce a siliceous froth which is sent to waste and a $PO_4$ concentrate that is added to the first concentrate product.

U.S. Pat. No. 3,013,664 described a process for flotation with a cationic flotation agent of a raw phosphate rock feed having a particle size of about −14/+150 mesh, desliming through a desliming cyclone, flotation with a cationic flotation reagent of a mixture of raw feed and a recirculated material to remove overflow or float comprising fine silica and activated coarse silica, and then conditioning the underflow or first rougher concentrate with an anionic flotation reagent and floating to remove the phosphate values as the overflow.

U.S. Pat. No. 3,388,793 is directed to washing and sizing a phosphate matrix to remove +16 mesh pebble and to deslime the −16 mesh fraction by removing the −150 mesh slimes, next to screen the −16/+150 mesh material to separate it into −16/+35 mesh material and −35/+150 mesh material, both of which are subjected to conditioning with an anionic reagent and rougher flotation to produce a combined concentrate which is acid scrubbed and then floated with a cationic reagent to produce a sink product consisting of phosphatic materials as the final concentrate.

U.S. Pat. No. 3,099,620 teaches the flotation of an unsized ore with an anionic reagent, dewatering both the froth and the underflow, mixing both with sulfuric acid and washing, and floating with a cationic reagent to produce phosphate containing underflow concentrates and overflow discard tails.

U.S. Pat. No. 3,349,903 describes a complicated process for maintaining desired solids concentrations of a −5 mesh feed controlling pH to the range of 8.5–11 to produce a first rougher feed which is floated with an anionic flotation reagent to produce a phosphate rich rougher overflow concentrate and a phosphate poor rougher tailing. The latter is deslimed, dewatered, mixed with water in two stages to 20–30% solids, projected to a pH of 6.8–7.3, and scavenger floated with a cationic flotation agent to produce a phosphate rich scavenger underflow tailing which is recovered. The phosphate rich overflow concentrate is treated with mineral acid, partially deoiled and dewatered, reconstituted with water to 20–30% solids, adjusted to a pH of 6.8–7.3, treated with a cationic flotation agent and subjected to cleaner flotation to produce phosphate rich cleaner underflow concentrate.

U.S. Pat. No. 3,388,793 describes a process for treating a deslimed phosphate ore by screening on a 35 mesh screen, adding an anionic reagent with coarse and fine fractions to obtain a phosphate-rich froth which is combined, scrubbed with acid, treated with a cationic reagent, and floated to obtain a tail as a product.

In general, present flotation practice for concentrating Florida phosphate ores is to use a two-stage process involving: A. conditioning the −14/+150 mesh ore at 60–70% solids with fatty acids at about 1 lb/ton, fuel oil at about 2 lbs/ton, and $NH_3$ or NaOH to produce a pH of 8–10; B. rougher flotation of phosphates (froth or rougher concentrates) from coarse silica (rougher tailings) to produce a rougher concentrate having 50–60% BPL; C. deoiling of the rougher concentrates with concentrated sulfuric acid; D. conditioning the rougher concentrates at 60–70% solids with fuel oil at 0.5 lb/ton and a $C_{16}-C_{18}$ primary amine acetate at 2 lbs/ton; and then E. cleaner flotation of the fine silica from the rougher concentrates to remove fine silica from the phosphate product having less than 5% insolubles and 70–72% BPL. Present phosphate recoveries are 70–80%.

This two-stage reverse flotation process, requiring removal of the anionic reagent with acid and, in some cases, pH control, is troublesome, expensive, and increasingly inefficient as the industry moves southward from Polk County to Hardee County in Florida and the available ores become increasingly lower in grade.

Other factors that are important in the reverse flotation method that is current used are that well water or limestone water must be used and depressants and/or deflocculators are often needed.

Accordingly, a simpler process is needed at the present time. This process should require fewer controls, fewer process steps, non-critically as to pH, non-critically as to water quality, and no need for depressants and deflocculators. It should also have the capability to operate on the lower grade ores that are increasingly necessary to use and be more efficient in phosphate recovery on such ores.

SUMMARY OF THE INVENTION

It is therefore an object of this invention to provide a process for treating phosphate ores with a single flotation agent.

It is further an object to provide a process that does does not require pH control.

It is additionally an object to provide a process that is non-critical as to water quality.

It is also another object to provide a process that does not require depressants and/or deflocculators.

It is still another object to provide a flotation process for phosphate ores that uses a cationic reagent for floating coarse and fine silica particles.

It is additionally an object to provide a process requiring no reagent removal with acid.

In accordance with these objectives and the principles of this invention, improved flotation processes for phosphate ore beneficiation are herein provided which use, as a cationic collector, a polyamine adduct of a long chain monoepoxide and a polyalkalene polyamine. This adduct is described in U.S. Pat. No. 3,824,111 for use as pigment dispersant, and the precursor, i.e., diketimine, is described in U.S. Pat. No. 3,322,797.

This process simplifies the conventional processes, which lose much fine and coarse phosphate, by elimination of the fatty acid conditioning and the de-oiling of the ores with sulfuric acid. Further, it involves only a single collector, does not require any pH control, and is not critical as to water quality.

This process for recovering phosphate values from deslimed phosphate ore, containing bone phosphate of lime and passing a 14 mesh screen, comprises the following steps for treating the ore: conditioning with a fuel oil, treating with a polyamine cationic collector and a frother, and frothing with air to remove silica particles from the ore in at least two floats having no pH adjustment step, no scrubbing step, and no oil removal step therebetween, the ore being recovered as at least 80 weight percent of the bone phosphate of lime and having insol values no greater than about 6 weight percent.

The frother is preferably a polypropylene glycol ether. However, methyl isobutyl carbinol, tri-ethoxybutane, and heptanols are also satisfactory.

The polyamine cationic collector has two functional amino groups per molecule on one end and an aliphatic substituent of 8–24 carbons attached to the tertiary nitrogen site on the other. The polyamine collector can be defined as a composition corresponding to the formula:

$$NH_2\text{-}(CH_2\text{-}CH_2\text{-}\overset{\overset{R}{|}}{N})_n\text{-}CH_2\text{-}CH_2\text{-}NH_2$$

where R is an aliphatic substituent containing between about 8–24 carbon atoms and between about 1–3 oxygen atoms and is derived from a monoepoxide, n is the integer 1 or 2, and one of the R substituents can be hydrogen when n is 2.

Illustrative of the monoepoxides from which the aliphatic substituents corresponding to R in the above structural formula are derived are those compounds which contain one 1,2-epoxide group per molecule and no other groups which are reactive with amine groups and which contain from about 8 to about 24 carbon atoms per molecule. Examples of monoepoxides are epoxidized hydrocarbons, epoxidized unsaturated fatty esters, monoglycidyl ethers of aliphatic alcohols and monoglycidyl esters of monocarboxylic acids. Examples of such monoepoxides are: epoxidized unsaturated hydrocarbons which contain 8 to 24 carbon atoms, e.g., octylene oxide, decylene oxide, dodecylene oxide and nonadecylene oxide; epoxidized monoalcohol esters of unsaturated fatty acids wherein the fatty acids contain about 8 to about 18 carbon atoms and the alcohol contains 1 to 6 carbon atoms, e.g., epoxidized methyl oleate, epoxidized n-butyl oleate, epoxidized methyl palmitoleate, epoxidized ethyl linoleate and the like; monoglycidyl ethers of monohydric alcohols which contain 5 to 21 carbon atoms, e.g., octyl glycidyl ether, decyl glycidyl ether, dodecyl glycidyl ether, tetradecyl glycidyl ether, hexadecyl glycidyl ether and octadecyl glycidyl ether; monoglycidyl esters of monocarboxylic acids which contain 8 to 20 carbon atoms, e.g., the glycidyl ester of capric acid, the glycidyl ester of lauric acid, the glycidyl ester of stearic acid, the glycidyl ester of arachidic acid and the glycidyl esters of aplha, alpha-dialkyl monocarboxylic acids described in U.S. Pat. No. 3,178,454 which is hereby incorporated by reference. Examples of such glycidyl esters are those derived from about 9 to about 19 carbon atoms, particularly Versatic 911 Acid, a product of Shell Oil Company, which acid contains 9 to 11 carbon atoms. The preferred monoepoxides are the monoglycidyl ethers of monohydric alcohols which alcohols contain 5 to 21 carbon atoms. The most preferred monoepoxides are the monoglycidyl ethers of monohydric alcohols which alcohols contain 12 to 14 carbon atoms.

Included in the definition of monoepoxides are monochlorohydrins, i.e., chlorohydrins of unsaturated hydrocarbons, chlorhydrins of unsaturated fatty esters, monochlorohydrin glyceryl ethers of aliphatic alcohols and monochlorohydrin glyceryl esters of monocarboxylic acids. As used in this invention, the term "monoepoxide" is intended to include "monochlorohydrin".

The ketimine is formed, for example, from the tri-amine or tetra-amine by reacting two moles of a ketone, e.g, methylisobutyl ketone, with one mole of tri-amine or tetra-amine. This ties up the primary amine functionalities permitting the monoepoxide to react at the secondary amine sites. The ketimines are later hydrolyzed with water reforming the primary amine functionalities.

A present invention polyamine collector compound can be prepared, for example, by the reaction of an appropriate aliphatic epoxide with diethylenetriamine diketimine or triethylenetetramine diketimine, in a manner similar to that described in U.S. Pat. No. 3,322,797. Two exemplary reactions are as follows:

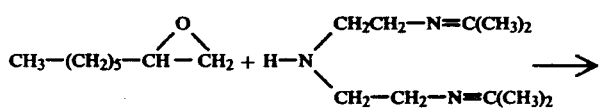

(1)

-continued

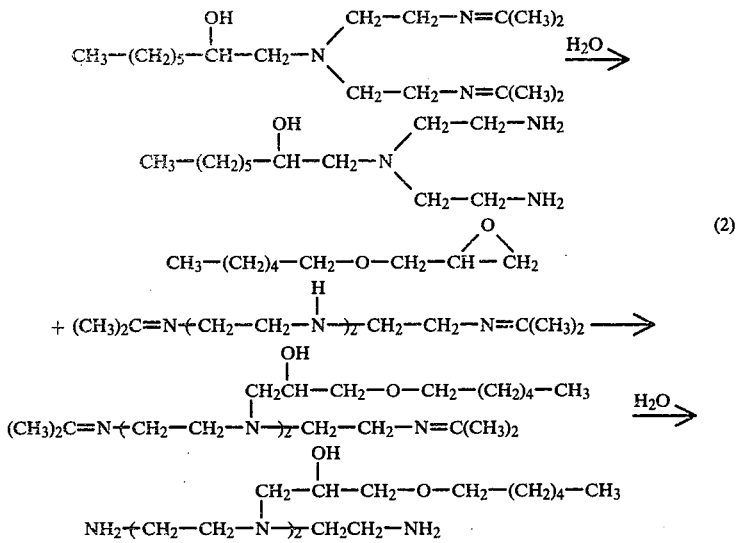

(2)

When used on a whole (unsized) ore after desliming thereof, one embodiment of this process uses the polyamine cationic collector of this invention to float both coarse and fine silica away from coarse phosphate particles in a silica rougher float. This operation is followed by dropping out the finer phosphate particles and some coarse silica in a cleaner silica float without addition of reagents, recleaning the froth therefrom to produce a tails fractions and a recleaner sink, screening the combined sink of the cleaner and recleaner silica floats at 48 mesh, combining the fine phosphate obtained by screening with the coarse phosphate of the silica rougher float into a phosphate concentrate while combining the +48 mesh fraction with the tails of the cleaner silica float to yield a final tails. The success of this embodiment depends on the ability of the collector to float most of the coarse and fine silica away from the coarse phosphate in the rougher float and also on the operability of the screening process to separate the coarse silica and the finer phosphate that are in the cleaner sink.

Another embodiment of this process comprises separating an unsized ore into two fractions over a 35 mesh screen, desliming both fractions, conditioning both deslimed fractions with fuel oil only, adding the cationic collector and a frother, and by froth flotation separating each of the ore fractions into a silica float and a phosphate concentrate.

Additional cleaning of floats and recycling of screened and/or flotation fractions can be used for specific ores and/or situations.

By increasing the oil to 1.50 pounds per ton for a fixed amount of cationic collector and frother, it is possible to make an acceptable concentrate with insol (defined as the fraction that is insoluble in aqua regia) below 5%. Reducing the dosage of the cationic collector below 0.2 pound per ton reduces its ability to selectively float silica from phosphate minerals while employing 0.5 pound per ton of fuel oil and 0.05 pound of frother per ton of ore. With a fixed quantity of the cationic collector, fuel oil #2 is more effective than fuel oil #5 or kerosene in yielding a selective float.

BRIEF DESCRIPTION OF THE DRAWINGS

The invention may be more fully understood by referring to the drawings.

DESCRIPTION OF THE PREFERRED EMBODIMENTS

Figure 1:
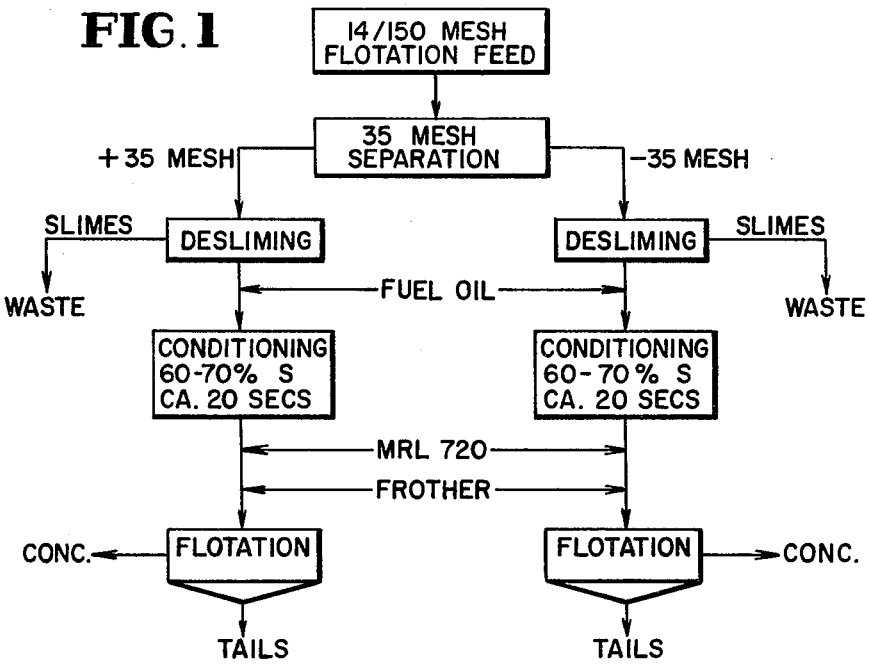
FIG. 1 illustrates one embodiment of the process of this invention for treating a raw phosphate ore in a screening step, a desliming step, a conditioning step, and a flotation step to produce two concentrate products.

The invention may be more thoroughly understood by referring to the following examples. Parts and percentages where used in the examples, unless otherwise specified, are parts by weight.

In all of these examples, the following steps were used for desliming the phosphate ores:

(1) add sufficient de-ionized water or deep well water to 250 g or 500 g of flotation feed in a 600 ml. or one liter beaker depending on size of sample to yield 60–70% solids;

(2) agitate for one minute with a laboratory four bladed stirrer at sufficient speed to suspend the mass of particles;

(3) turn off agitator and allow the mass to settle for one minute;

(4) decant the supernatant liquid; and (5) repeat the addition of water and the decantation four additional times.

The procedure for conditioning the deslimed solids is all of these examples requires addition of water to 60–70% solids, followed by addition of fuel oil while agitating. The total agitation time was less than 20 seconds.

Flotation of the deslimed and conditioned solids was performed according to the following steps in all examples:

(1) After conditioning, the feed was transferred to a 250 or 500 gram Denver cell used with a Type D-1 Denver laboratory flotation machine.
(2) Without agitation, water was added to about 1 inch below the lip and the agitator turned on for 2–5 seconds without air to set it in place.
(3) The required amount of polyamine collector was added immediately after restarting agitation, followed by frother addition. The total elapsed time for these additions was less than 15 seconds.
(4) The air was then turned on with the agitator set for 1200 or 1400 rpm depending on cell size.
(5) The silica flocs came up almost immediately and were scraped into a pan as quickly as possible while adding makeup water as needed. Normally, about 1–1.5 minutes were required to complete the operation.
(6) The float was designated tails and the sink concentrate. These were dried, weighed, and assayed for acid insol by standard procedures used in the phosphate industry. If the insols were low enough in the concentrates, B.P.L. (bone phosphate of lime) assays were also determined.

The terminology used herein for screened fractions is to show the plus fraction on the left and the minus fraction on the right, e.g., 14/35, meaning −14/+35 for the oversize fraction retained after screening on a 35 mesh Tyler screen and 35/150, meaning −35/+150 for the undersized but deslimed fraction passing through this screen. Analytical procedures used for drying, weighing, and assaying for "acid insol" are the standard procedures used in the phosphate industry. The collectors used in this invention are described hereinafter in Examples A-U and are referred to in the examples and tables by the letters. In the following tables, D-250 is a trademark of the Dow Chemical Company for a polypropylene glycol ether used as the frothing agent. F.O. #2 is an abbreviation for No. 2 fuel oil. Four drops of D-250 equals 0.1 pound per ton of ore. BPL-R indicates percentages of recovery of the BPL in the feed.

The cationic collectors used in the examples are as follows:

EXAMPLE A

To a suitable reactor equipped with an azeotropic distillation well were added 573 parts of diethylene triamine and 1390 parts of methylisobutyl ketone plus an additional 80 parts for the well. To the well were also added 700 parts of water. Heat was applied raising the temperature of the reactants to 104° C., at which point azeotropic distillation of water and methylisobutyl ketone began. The distilled water was retained in the well and the methylisobutyl ketone was returned to the reactor. During this distillation, the temperature slowly rose and when it reached 150° C., about 190 parts of distilled water had been collected. The refractive index of the reactants was 1.4500. Heating was discontinued allowing the temperature in the reactor to drop to 90° C. When this temperature was reached, 1587 parts of a monoglycidyl ether of mixed alcohols, predominantly n-dodecyl and n-tetradecyl alcohols, were added, said monoglycidyl ether having an epoxide equivalent weight of 286 and a viscosity at 25° C. of 8.5 cps. The reactants were heated to 121° C., at which point heating was discontinued. The temperature, however, rose to 140°–150° C. due to the exothermic reaction. The temperature was held at 150° C. for 30 minutes and was then lowered to 93° C.

The amount of water in the azeotropic distillation well was adjusted to 600 parts. 400 parts of this water were then drained into the reactor leaving 200 parts in the well. Heat was applied raising the temperature to 93°–95° C. where distillation began. The methylisobutyl ketone distillate was removed while the water was returned to the reactor. The water level in the well was kept at the 200 parts mark. When about 1000 parts of methylisobutyl ketone had been distilled over, all the water from the well was drained into the reactor. Heating was continued until all the methylisobutyl ketone had been distilled from the reactor. The temperature was then raised to 149° C. while distilling off water. The temperature was held at 149° C. for 30 minutes while bubbling nitrogen gas through the reactor contents. After this time, the reactor contents had a non-volatiles content (0.4 gram sample heated at 150° C. for 20 minutes) of 90%. The reactor contents were cooled to 70°–75° C., were filtered and were stored in suitable containers.

The resulting product, at 90% N.V. in water, had a Gardner-Holdt viscosity at 25° C. of Y and a weight per gallon of 8.0 pounds.

EXAMPLE B

Part I

To a reactor equipped with a stirrer, reflux condenser and Barrett trap were added 206.4 parts of diethylene triamine and 400.8 parts of methylisobutyl ketone. To the trap were added 18.5 parts methylisobutyl ketone. Heating and stirring were applied and at 112° C., water-methylisobutyl ketone azeotropic distillation began. Heating was continued for 7 hours with the temperature rising to 213° C. while removing water and returning the ketone. The reactor was fitted for vacuum distillation, heat was applied and at 124° C., water aspirator vacuum was applied. The temperature was raised to 140° C. over a 32 minute period under vacuum. 511.1 parts of diethylenetriamine-methylisobutyl ketone diketimine were recovered.

Part 2

To a suitable reactor equipped with a dropping funnel were added 137.9 parts of fatty alcohols, which were a mixture of about 65% $C_{12}$ alcohol, 26% $C_{14}$ alcohol with the remainder being $C_{16}$ alcohol. To the dropping funnel were added 64.8 parts of epichlorohydrin. $BF_3$ etherate (0.4 part) was added to the reactor with stirring and heat was applied. At 67° C. slow addition of epichlorohydrin was begun and was completed over a one hour period while keeping the temperature between 67° and 75° C. After the addition was completed, heating was continued for one hour at 67°–72° C.

With the temperature at 72° C., 187.3 parts of the diethylene triamine diketimine described in Part 1 were added. When thoroughly mixed in and with the temperature at 61° C., 5.8 parts of sodium hydroxide were added. At 15 minute intervals, four additional portions of sodium hydroxide (3 portions of 5.8 parts and one of 6.0 parts) were added while keeping the temperature at 64°–68° C. Heating was continued for one hour raising the temperature to 74° C. Deionized water, 50.4 parts, was then added and the temperature was raised to 111° C. to azeotropically distill methylisobutyl ketone while returning water to the reactor. Heating and distilling were continued for 3 hours and 30 minutes with the temperature rising to 122° C.

To the reactor were added 100 parts of toluene, heat was applied and at 70° C., water aspirator vacuum was applied to distill water and toluene. After 57 minutes the temperature had risen to 122° C. and the distillation was completed. The reactor contents were filtered to remove the salt. The resulting product, 293.8 parts yield, had a Gardner-Holdt viscosity at 25° C. of J-K, a wt/gal. of 7.81 lbs. and a Gardner color of 11.

EXAMPLES C–K

Additional modified polyamines were prepared using the procedures described in Examples A or B.

Collector C is the reaction product of one mol of the chlorohydrin ether of a fatty alcohol mixture containing about 26% $C_{16}$ alcohol, 65% $C_{18}$ alcohol with the remainder being $C_{14}$, $C_{17}$ and $C_{20}$ alcohols and one mol of the diethylene triamine-methylisobutyl ketone diketimine subsequently hydrolyzed to the amine.

Collector D is the reaction product of one mole of the chlorohydrin ether of a $C_8$ to $C_{10}$ fatty alcohol and one mol of the diethylene triamine-methylisobutyl ketone diketimine subsequently hydrolyzed to the amine.

Collector E is the reaction product of one mol of an epoxidized 1,2 olefin containing 15 to 18 carbon atoms and having an oxirane content of 5.9% and one mol of the diethylene triamine-methylisobutyl ketone diketimine subsequently hydrolyzed to the amine.

Collector F is the reaction product of one mol of an epoxidized 1,2 olefin containing 20 to 24 carbon atoms and having an oxirane content of 4.4% and one mol of the diethylene triamine-methylisobutyl ketone diketimine subsequently hydrolyzed to the amine.

Collector G is the reaction product of 2 mols of the monoglycidyl ether described in Example A with one mol of the triethylene tetramine-methylisobutyl ketone diketimine subsequently hydrolyzed to the amine.

Collector H is the reaction product of 1 mol of the monoglycidyl ether described in Example A with one mol of the triethylene tetramine-methylisobutyl ketone diketimine subsequently hydrolyzed to the amine.

Collector I is the reaction product of 1 mol of the monoglycidyl ether described in Example A with two mols of the triethylene tetramine-methylisobutyl ketone diketimine subsequently hydrolyzed to the amine.

Collector J is the reaction product of 1 mol of the monoglycidyl ether described in Example A with one mol of 3-azahexane-1,6-diamine-methylisobutyl ketone diketimine subsequently hydrolyzed to the amine.

Collector K is the reaction product of 1 mol of an epoxidized, 1,2-olefin containing 11 to 14 carbon atmos and having an oxirane content of 7.63% and 1 mol of the diethylene triamine-methylisobutyl ketone diketimine subsequently hydrolyzed to the amine.

EXAMPLES L–U

Additional amine compounds used in the examples are:

Collector L is the one to one molar Michael addition reaction product of the acrylic acid ester of the monoglycidyl ether described in Example A and ethylene diamine.

Collector M is the 2 to 1 molar reaction product of ethylene diamine and the diglycidyl ether of butanediol.

Collector N is the 1 to 1 molar reaction product of the chlorohydrin ether of a $C_{12}$–$C_{14}$ fatty alcohol and dimethyl-aminopropyl amine.

Collector O is an amino-amide made by reacting 1 mol of tall oil fatty acids with 0.75 mol of diethylene triamine.

Collector P is N-n-Tridecoxy-n-Propyl-1,3-Propylene-diamine Monoacetate.

Collector R is a diamine having the structure

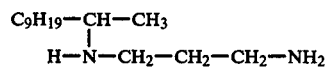

wherein $C_9H_{19}$ is linear

Collector S is a quaternary ammonium salt having the structure

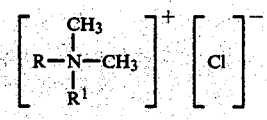

wherein R and $R^1$ are a mixture of hydrocarbon radicals which are octadecyl and hexadecyl in about a 3 to 1 weight ratio.

Collector T is isodecyl ether amine acetate.

Collector U is an 18 carbon atom primary amine.

EXAMPLE 1

A 14/35 feed from a Florida phosphate operation was treated according to the left side of the flow sheet in FIG. 1 to determine the optium quantities of fuel oil and cationic collector to be used for flotation of siliceous gangue from a coarse phosphate feed. Table I summarizes the data that were obtained for eight tests on the 14/35 mesh feed. Assays for BPL were not made on concentrates that appeared under the microscope or visually to contain high insol contents. Excellent grades and recoveries were obtained in tests 1–7 and 1–8, as compared with grades of 60–65% BPL and recoveries of 50-60% BPL-R which are provided by current processes on such coarse feeds, as given in *Agglomeration-Skin Flotation of Coarse Phosphate Rock* by M. Moudjil and D. H. Barnett, Society of Mining Engineers, Preprint No. 77-B-77, presented at AIME Annual Meeting, Atlanta, Georgia, Mar. 6–10, 1977.

EXAMPLE 2

A −35 mesh feed was obtained from the same phosphate operation in Florida from which Example 1 was procured. The procedures used for rougher flotation of the siliceous gangue from the fine phosphate feed were similar to those used in Example 1. Tests were made to show that acceptable grades could be obtained, but no attempt was made to optimize the recoveries. Clearly, recoveries could be increased by cleaning the tails as described in the following example.

TABLE I

Flotation Of Siliceous Gangue From A Coarse Phosphate Feed Using 4 Drops Of DOWFROTH-250

| Test | FLOTATION REAGENTS, LB/T | | CONCENTRATE | | | | TAILS | | |
|---|---|---|---|---|---|---|---|---|---|
| No. | F.O. #2 | Collector A | Wt % | % Insol | % BPL | BPL-R | Wt % | % BPL | BPL-R |
| 1-1 | 0.5 | 0.20 | 56.67 | 21.60 | — | — | 43.33 | — | — |
| 1-2 | 1.0 | 0.20 | 50.93 | 14.60 | — | — | 49.07 | — | — |
| 1-3 | 1.0 | 0.25 | 50.18 | 14.47 | — | — | 49.82 | — | — |
| 1-4 | 0.5 | 0.25 | 52.48 | 17.56 | — | — | 48.52 | — | — |
| 1-5 | 1.5 | 0.20 | 46.82 | 9.00 | — | — | 53.18 | — | — |
| 1-6 | 2.0 | 0.20 | 46.50 | 8.25 | — | — | 53.50 | — | — |
| 1-7 | 2.5 | 0.20 | 44.41 | 6.13 | 72.87 | 86.1 | 55.59 | 9.64 | 13.9 |
| 1-8 | 2.0 | 0.25 | 43.94 | 5.99 | 72.69 | 84.8 | 56.06 | 10.49 | 15.2 |

TABLE II

Rougher Flotation Of Siliceous Gangue From A Fine Phosphate Feed, Using 4 Drops Of DOWFROTH-250

| Test | FLOTATION REAGENTS, LB/T | | CONCENTRATE | | | | TAILS | | |
|---|---|---|---|---|---|---|---|---|---|
| No. | F.O. #2 | Collector A | Wt % | % Insol | % BPL | BPL-R | Wt % | % BPL | BPL-R |
| 2-1 | 0.5 | 0.20 | 37.94 | — | — | — | 62.06 | — | — |
| 2-2 | 1.0 | 0.20 | 46.81 | — | — | — | 53.19 | — | — |
| 2-3 | 0 | 0.20 | 46.35 | — | — | — | 53.45 | — | — |
| 2-4 | 1.5 | 0.20 | 28.97 | 4.37 | 73.95 | 72.0 | 71.03 | 12.18 | 28.0 |
| 2-5 | 2.0 | 0.20 | 25.83 | 2.38 | 75.88 | 69.2 | 74.17 | 11.90 | 30.8 |

Table II summarizes the results that were obtained. It is apparent that acceptable grades were produced by tests 2–4 and 2–5.

EXAMPLES 3–11

The following Examples 3—11 relate to unisized ore (14/150 mesh or 20/150 mesh). This unsized ore was treated according to the flow diagram shown in FIG. 2 in one or another modification, as indicated therein. Such modifications commonly occur in practice as the operators judge the rougher flotation sink to be of adequate grade or estimate that the cleaning stages can be by-passed if the rougher float is sufficiently low in phosphorous, for example. For obtaining the best grade and recovery, however, all steps indicated in FIG. 2 should be utilized.

Figure 2:
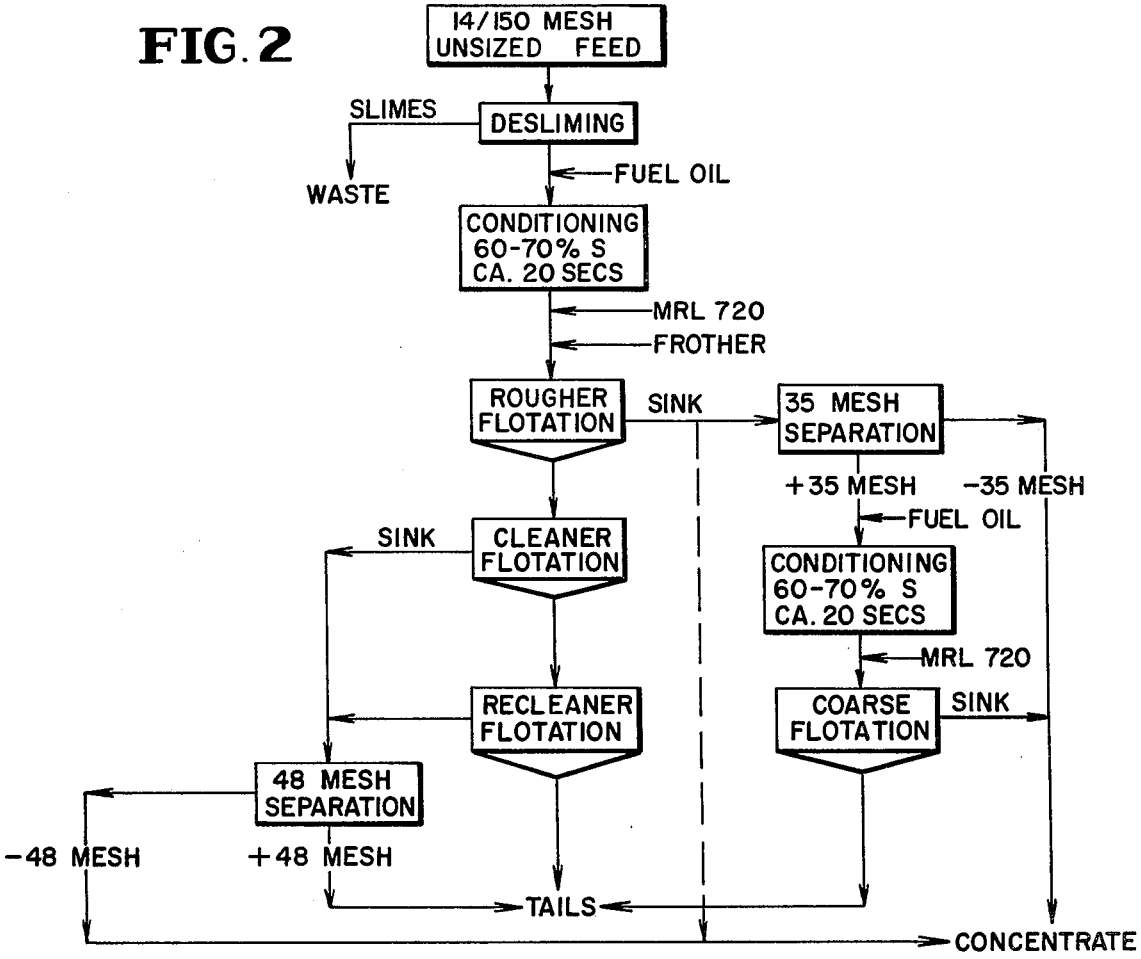
FIG. 2 shows another embodiment of this process for treating a raw ore by desliming, a conditioning step with fuel oil, a rougher flotation step, two cleaner flotation steps for the tails, a 35 mesh separation of the rougher flotation sink, conditioning of the +35 mesh fraction with fuel oil, and coarse flotation to produce a tails reject and a sink concentrate or product which is combined with the −35 mesh fraction. The sinks of the cleaner flotation step are also separated on 48 mesh screens to produce a −48 mesh concentrate and +48 mesh tails which are rejected.

FIG. 2 is based upon Florida phosphate operations that do not size their flotation feeds into coarse and fine fractions as in the operation shown in FIG. 1. As a result, they lose much of the +35 mesh phosphate particles in the rougher fatty-acid fuel oil float when operating according to the current conventional process.

In contrast, most of the coarse phosphate can be recovered when the process shown in FIG. 2 is used with the polyamine collector and according to the teaching of this invention.

The steps of the flow diagram shown in FIG. 2 include the same desliming procedure, the same conditioning procedure with fuel oil, and the same flotation procedure as described for Examples 1 and 2. The further steps involving cleaning and coarse flotation are as follows:

(1) The cleaning step was carried out on the silica obtained as the rougher float. This material was returned to the 500 gram float cell and refloated without addition of reagents. The cleaner sink was sized wet on a relatively fine screen, such as a 48 mesh screen, to separate relatively coarse silica particles from relatively fine phosphate particles. The +48 mesh fraction was added to the final tails to be rejected and the −48 mesh fraction was added to the final concentrate to be retained as product. The water used in the screening and filtering was recycled to recleaner flotation.

(2) The recleaning step was carried out by returning the cleaner float to the 500 g. float cell and again refloating this material without addition of reagents. The recleaner sink was similarly sized wet on a 48 mesh screen and separated into a +48 mesh fraction which was also added to the final tails and into a −48 mesh fraction which was also added to the final concentrate.

(3) The rougher sink was wet screened at −35 mesh to produce a −35 mesh fraction, which was dewatered and sent to the final concentrate to be combined with the −48 mesh screen fractions from the cleaner and recleaner flotations, and a +35 mesh fractions which was conditioned and floated to produce a froth which was removed and dewatered. The +35 mesh float solids were added to the final tails to be rejected. The +35 mesh sink from the coarse flotation was dewatered and was sent to the final concentrate to be combined with the −48 mesh concentrate products.

EXAMPLE 3

Three tests were made on this unsized phosphate ore according to the flow diagram shown in FIG. 2, with the results shown in Table III. These tests were intended to investigate the effects of varying the amounts of cationic collector and of fuel oil in the rougher flotation step, with conditions in the coarse flotation step (on the +35 mesh sink fraction from the rougher flotation) being held constant. The results show good recoveries of bone phosphate of lime (BPL) and satisfactorily low insols in the combined concentrates.

EXAMPLE 4

The eight tests which constitute this example were made on an unsized ore taken from the same phosphate mine as the ore used in Example 3 but taken many months later. The treatment used in these eight tests was similar to that used in Example 3.

The results are broken down in the same manner as in Table III, showing the reagents used for the rougher flotation and for the coarse flotation of the +35 mesh fraction from the rougher sink. The feed is characterized only as to the percent BPL therein. The combined concentrates are characterized with respect to the weight percent recovered, the percent of BPL therein, the percent insol therein, and the weight percent of BPL recovered with respect to the BPL fed (%BPL-R).

Unless insol assays were fairly close to 5% or less, BPL assays were not run. Very frequently, operator judgement as to the appearance of the combined concentrate or microscopic analyses are entirely sufficient to indicate the quality of the recovered material so that judgment as to approximate BPL assay are easily made thereon.

In the first six tests shown in Table 4, quantity of reagents added in the rougher flotation were held constant while variations were made in reagents added for the coarse flotation step. Tests 4–5 and 4–6 are duplicates and furnish an estimate of the reproducibility of the analyses. In the test 4–7, the amount of fuel oil No. 2 was increased for the rougher flotation step as compared to test 4–6, and in test 4–8, the effect of increasing the collector in the coarse flotation step, as compared to test 4–7, was investigated.

The last four tests in which BPL analyses were made show that excellent results were obtained as to both BPL recovery and quality (i.e., a small amount of silica, as indicated by "% insol"). Tests 4–7 and 4–8 indicate that increasing the amount of fuel oil in the rougher flotation step decreased the weight of the product recovered and the percentage of BPL recovered but improved the quality by reducing the amount of insol. Test 4–8 indicates that an increase in the amount of collector in the coarse flotation step continued this trend.

TABLE III

Flotation Of Silicates From Unsized Phosphate Ore Feeds, Using 4 Drops Of DOWFROTH-250

| | FLOTATION REAGENTS, LB/T | | | | | COMBINED CONCENTRATES | | | |
|---|---|---|---|---|---|---|---|---|---|
| | ROUGHING | | COARSE | | | | | | |
| Test No. | F.O. #2 | Collector A | F.O. #2 | Collector A | FEED BPL % | WT % | BPL % | INSOL % | BPL-R % |
| 3-1 | — | 0.20 | 0.50 | 0.20 | 20.34 | 23.28 | 65.67 | 5.09 | 75.0 |
| 3-2 | 0.125 | 0.20 | 0.50 | 0.20 | 20.38 | 22.27 | 67.00 | 4.53 | 73.2 |
| 3-3 | — | 0.175 | 0.50 | 0.20 | 19.75 | 22.69 | 67.05 | 4.02 | 76.9 |

TABLE IV

Flotation Of Silicates From Unsized Phosphate Ore Feeds, Using 4 Drops Of DOWFROTH-250

| | FLOTATION REAGENTS, LB/T | | | | | COMBINED CONCENTRATES | | | |
|---|---|---|---|---|---|---|---|---|---|
| | ROUGHING | | COARSE | | | | | | |
| Test No. | F.O. #2 | Collector A | F.P. #2 | Collector A | FEED BPL % | WT % | BPL % | INSOL % | BPL-R % |
| 4-1 | 0.25 | 0.20 | 0.25 | 0.15 | 18.0 | 22.70 | — | 7.59 | — |
| 4-2 | 0.25 | 0.20 | 0.25 | 0.20 | 18.0 | 22.37 | — | 7.22 | — |
| 4-3 | 0.25 | 0.20 | 0.50 | 0.10 | 18.0 | 21.83 | — | 5.77 | — |
| 4-4 | 0.25 | 0.20 | 0.50 | 0.15 | 18.0 | 20.58 | — | 5.84 | — |
| 4-5 | 0.25 | 0.20 | 0.50 | 0.20 | 18.1 | 21.50 | 70.11 | 5.68 | 83.4 |
| 4-6 | 0.25 | 0.20 | 0.50 | 0.20 | 18.6 | 22.00 | 70.31 | 5.01 | 83.2 |
| 4-7 | 0.375 | 0.20 | 0.50 | 0.20 | 18.4 | 20.32 | 71.23 | 4.54 | 79.0 |
| 4-8 | 0.375 | 0.20 | 0.50 | 0.25 | 17.9 | 19.16 | 71.16 | 3.89 | 76.3 |

EXAMPLE 5

Data are shown in Table V on five tests which were performed on an unsized flotation feed sample taken from the same phosphate mining operation as Examples 3 and 4 but at a different time. This sample did not require desliming and was tested without the 35 mesh separation to determine if the rougher flotation sink, following the verticle line from the rougher flotation sink line to the concentrate line in FIG. 2, could produce an acceptable combined concentrate (rougher sink plus the two −48 mesh cleaner sinks) of about 5% or less insol.

As shown in Table V, the amount of collector was held constant at 0.2 pound per ton and the amount of frother was held constant at 2 drops in the rougher flotation with an additional one drop in the cleaner and recleaner operations. Changes were made in the amount of fuel oil used in conditioning for the rougher flotation step. The results indicate that by increasing the fuel oil to 1.50 pounds per ton for the fixed amounts of collector and frother, it is possible to produce acceptable concentrate with insol below 5% when following the modification of the process in FIG. 2 according to the vertical line from the rougher flotation sink.

EXAMPLE 6

In this example, the same ore was used as in Example 5 but only rougher flotation was carried out in order to study the effect of using dosages of collector below 0.2 pound per ton while employing 0.5 pound per ton of fuel oil and two drops of frother.

TABLE V

Flotation Of Silicates From Unsized Phosphate Ore Feeds Using The Rougher Sink And Minus 48 Mesh Sinks From Cleaning And Recleaning In The Combined Concentrates, Using 0.2 lb/ton Of Collector A

| TEST NO. | TYPE FLOAT | REAGENTS F.O. #2 LB/T | REAGENTS D-250 DROPS | WT % | % INSOL |
|---|---|---|---|---|---|
| 5-1 | ROUGHING | 0.50 | 2 | 14.25 | 7.53 |
| | CLEANING | — | 1 | 3.31 | 3.49 |
| | RECLEANING | — | 1 | 2.59 | 5.70 |
| | COMBINED CONC. | | | 20.15 | 6.63 |
| 5-2 | ROUGHING | 0.75 | 2 | 13.41 | 6.89 |
| | CLEANING | — | 1 | 2.83 | 2.61 |
| | RECLEANING | — | 1 | 2.51 | 4.60 |
| | COMBINED CONC. | | | 18.75 | 5.94 |
| 5-3 | ROUGHING | 1.00 | 2 | 12.98 | 6.29 |
| | CLEANING | — | 1 | 2.60 | 3.34 |
| | RECLEANING | — | 1 | 2.24 | 3.63 |
| | COMBINED CONC. | | | 17.82 | 5.60 |
| 5-4 | ROUGHING | 1.25 | 2 | 12.50 | 6.26 |
| | CLEANING | — | 1 | 2.76 | 2.51 |
| | RECLEANING | — | 1 | 2.36 | 2.98 |
| | COMBINED CONC. | | | 17.62 | 5.23 |
| 5-5 | ROUGHING | 1.50 | 2 | 12.44 | 5.70 |
| | CLEANING | — | 1 | 2.92 | 3.24 |
| | RECLEANING | — | 1 | 2.52 | 2.63 |
| | COMBINED CONC. | | | 17.88 | 4.87 |

TABLE VI

Flotation Of Silicates From Unsized Phosphate Ore Feeds Using Roughing Only With 0.5 LB/T Of Fuel Oil No. 2 And 2 Drops Of DOWFROTH-250 And Varying Dosage Of Collector

| TEST No. | REAGENTS-LB/T COLLECTOR A | WT % FLOAT | Wt % SINK | % INSOL-SINK |
|---|---|---|---|---|
| 6-1 | 0.20 | 85.49 | 14.51 | 7.78 |
| 6-2 | 0.20 | 86.00 | 14.00 | 7.84 |
| 6-3 | 0.15 | 81.90 | 18.10 | 9.43 |
| 6-4 | 0.10 | 67.92 | 32.08 | +20 |
| 6-5 | 0.10 | 65.40 | 34.60 | +20 |

TABLE VII

The Effect Of Type Of Neutral Oil On Flotation Of Silicates From Unsized Phosphates Ore Feeds, Using 0.20 LB/T Of COLLECTOR A And 0.5 LB/T Of Neutral Oil

| TEST NO. | TYPE FLOAT | REAGENTS OIL TYPE | REAGENTS D-250 DROPS | WT % | % INSOL |
|---|---|---|---|---|---|
| 7-1 | ROUGHING | KEROSENE | 2 | 15.49 | 9.43 |
| | CLEANING | — | 1 | 5.47 | 15.00 |
| | RECLEANING | — | 1 | 4.40 | 35.76 |
| | COMBINED CONC. | | | 25.36 | 15.62 |
| 7-2 | ROUGHING | FUEL OIL #5 | 2 | 14.56 | 9.18 |
| | CLEANING | — | 1 | 3.94 | 6.20 |
| | RECLEANING | — | 1 | 2.07 | 9.07 |
| | COMBINED CONC. | | | 20.57 | 8.74 |
| 7-3 | ROUGHING | FUEL OIL #2 | 2 | 14.25 | 7.53 |
| | CLEANING | — | 1 | 3.31 | 3.49 |
| | RECLEANING | — | 1 | 2.59 | 5.70 |
| | COMBINED CONC. | | | 20.15 | 6.63 |

The results which are summarized in Table VI show that reducing the dosage of collector below 0.2 pound per ton reduces its ability to selectively float the silica from the phosphate minerals because the weight percent of the float drastically decreases while the weight percent of the sink correspondingly increases and the percent insol in the sink climbs to wholly unacceptable levels. The weight percent in the float show the very high flotation possibilities that are feasible with this collector system and the ability of the collector to attract silica.

EXAMPLE 7

Using an unsized phosphate ore, as in Examples 3 through 6, the effect of type of neutral oil in the conditioning step on the flotation of silicates from the unsized phosphate ore feeds was studied in three tests, as indicated in Table VII with respect to the rougher flotation step and the two cleaning steps. These tests utilized kerosene, fuel oil #5, and fuel oil #2, using the dosage levels for the first test of Example 5 which are reproduced as the third test of this example.

EXAMPLE 8

An estimation of the effects of various commercial frothers was made by using the rougher flotation step only and using fixed amounts of fuel oil and collector, similarly to the investigation as to desirable reagent level that was used in Example 6. In these eight tests, the amounts of fuel oil and collector were held constant at about the level that was found desirable in the preceding examples and the frothers were tested at three levels, i.e., four drops, two drops, and one drop except for cresylic acid.

These results show that Dowfroth 250 (a polypropylene glycol ether) was the strongest frother, followed closely by MIBC (methyl isobutylcarbinol). Other frothers such as TEB (triethoxybutane), heptanol, UCON-R190, and UCON-R200 (obtained from Union Carbide) were also good performers.

EXAMPLE 9

In this example, 20 types of amine structures were tested in rougher floats only on the ores of Examples 3 and 5. Each of these amine structures is listed in Examples A-U.

In Table IX*a*, 20 tests show the effect of various amine structures on flotation of silicates from an unsized phosphate ore feed (similar to the ore of Example 3), using single-stage roughing only as in FIG. 2. The results are given with respect to both the rougher float and the rougher sink, with BPL analyses and BPL recoveries being listed where appropriate and insol assays being replaced by visual or microscopic estimates of the grade. Test No. 9-11 resulted in excellent recovery, but the concentrate was visually appraised as being too high in insol. These results point to the greater selectivity of the alkyl adducts of DETA ketimines of this invention over the standard commercial amines and other alternative structures.

TABLE IXa

The Effect Of Various Amine Structures On Flotation Of Silicates From Unsized Phosphate Ore Feeds Using Single Stage Roughing Only After Conditioning With 2.0 LB/T Of Fuel Oil No. 2, Using No Frother

| TEST | FLOTATION | | FEED | RO. FLOAT | | | RO. SINK | | | |
|---|---|---|---|---|---|---|---|---|---|---|
| NO. | COLLECTOR | LB/T | % BPL | WT % | % BPL | BPL-R | WT % | % BPL | BPL-R | REMARKS |
| 9-1 | A | 0.50 | 21.2 | 80.9 | 11.75 | 44.7 | 18.5 | 63.25 | 55.3 | — |
| 9-2 | A | 0.25 | 20.7 | 70.9 | 5.40 | 18.5 | 28.4 | 59.25 | 81.5 | — |
| 9-3 | A | 0.20 | — | 59.7 | — | — | 39.6 | — | — | GRADE VERY POOR |
| 9-4 | B | 0.50 | 18.9 | 73.8 | 6.95 | 28.0 | 23.1 | 59.00 | 72.0 | — |
| 9-5 | B | 0.38 | 20.1 | 72.9 | 5.85 | 21.2 | 26.4 | 60.15 | 78.8 | — |
| 9-6 | B | 0.25 | — | 56.8 | — | — | 42.5 | — | — | GRADE VERY POOR |
| 9-7 | C | 0.25 | 22.7 | 74.4 | 9.00 | 29.5 | 24.9 | 64.15 | 70.5 | — |
| 9-8 | C | 0.20 | — | 55.6 | — | — | 43.7 | — | — | GRADE VERY POOR |
| 9-9 | D | 0.38 | — | 65.8 | — | — | 33.5 | — | — | GRADE VERY POOR |
| 9-10 | D | 0.25 | — | 45.6 | — | — | 53.7 | — | — | GRADE VERY POOR |
| 9-11 | K | 0.38 | 19.7 | 71.8 | 3.60 | 13.1 | 27.5 | 62.10 | 86.9 | GOOD RECOVERY |
| 9-12 | K | 0.25 | — | 43.5 | — | — | 55.7 | — | — | GRADE VERY POOR |
| 9-13 | N | 0.25 | — | 40.8 | — | — | 56.5 | — | — | GRADE VERY POOR |
| 9-14 | O | 0.25 | — | — | — | — | — | — | — | DISCARDED-VERY POOR |
| 9-15 | U | 0.75 | — | 60.7 | — | — | 38.6 | — | — | GRADE VERY POOR |
| 9-16 | U | 0.50 | — | 40.4 | — | — | 58.9 | — | — | GRADE VERY POOR |
| 9-17 | P | 0.25 | — | 37.4 | — | — | 61.8 | — | — | GRADE VERY POOR |
| 9-18 | S | 0.25 | — | — | — | — | — | — | — | DISCARDED-VERY POOR |
| 9-19 | R | 0.25 | — | — | — | | — | — | — | DISCARDED-VERY POOR |
| 9-20 | T | 0.25 | — | — | — | — | — | — | — | DISCARDED-VERY POOR |

TABLE VIII

The Effect Of Commercial Frothers On Flotation Of Silicates From Unsized Phosphate Ore Feeds

| TEST NO. | FROTHER | DROPS | WT % OF SINK | % ACID INSOL |
|---|---|---|---|---|
| 8-1 | DOWFROTH-250 | 4 | 12.27 | 8.38 |
| | | 2 | 12.64 | 7.30 |
| | | 1 | 14.71 | 7.36 |
| 8-2 | MIBC | 4 | 13.88 | 7.22 |
| | | 2 | 16.24 | 7.22 |
| | | 1 | 21.86 | 18.75 |
| 8-3 | TEB | 4 | 14.17 | 8.44 |
| | | 2 | 14.49 | 8.15 |
| | | 1 | 16.77 | 8.77 |
| 8-4 | PINE OIL | 4 | 13.10 | 9.05 |
| | | 2 | 14.46 | 9.09 |

TABLE VIII-continued

The Effect Of Commercial Frothers On Flotation Of Silicates From Unsized Phosphate Ore Feeds

| TEST NO. | FROTHER | DROPS | WT % OF SINK | % ACID INSOL |
|---|---|---|---|---|
| | | 1 | 18.28 | 11.48 |
| 8-5 | CRESYLIC ACID | 4 | 19.94 | 12.65 |
| | | 6 | 16.20 | 8.73 |
| 8-6 | HEPTANOL | 4 | 14.07 | 8.57 |
| | | 2 | 14.10 | 8.00 |
| | | 1 | 17.20 | 7.93 |
| 8-7 | UCON-R190 | 4 | 13.38 | 8.35 |
| | | 2 | 13.18 | 8.66 |
| | | 1 | 15.04 | 8.91 |
| 8-8 | UCON-R200 | 4 | 14.08 | 8.74 |
| | | 2 | 15.41 | 10.55 |
| | | 1 | 14.37 | 8.61 |

TABLE IXb

The Effect Of Carbon Chain Length Of Monoepoxide DETA Ketimine Reaction Product On Flotation Of Silicates From Unsized Phosphate Flotation Ore Feeds Using Single Stage Roughing Only And Using 4 Drops Of MIBC As Frother

| TEST | | | ROUGHER CONCENTRATE | | |
|---|---|---|---|---|---|
| NO. | COLLECTOR | LB/T | WT % | % INSOL | C'S |
| 9-21 | A | 0.20 | 14.73 | 7.75 | 11–14 |
| 9-22 | E | 0.20 | 15.70 | 10.48 | 13–16 |
| 9-23 | F | 0.20 | 14.60 | 8.77 | 20 |
| 9-24 | A | 0.25 | 14.08 | 7.83 | 11–14 |
| 9-25 | E | 0.25 | 13.00 | 8.76 | 13–16 |
| 9-26 | F | 0.25 | 13.39 | 8.38 | 20 |

TABLE IXc

The Effect Of Various Amine Structures On Flotation Of Silicates From Unsized Phosphate Ore Feed Using Single Stage Roughing Only, After Conditioning With 1.50 LB/T Of Fuel Oil #2, With D-250 As Frother

| TEST | | DOSAGE | ROUGHER SINK | |
|---|---|---|---|---|
| NO. | COLLECTOR | (LB/T) | WT % | % INSOL |
| 9-27 | A | 0.20 | 12.44 | 5.70 |
| 9-28 | I | 0.20 | 14.05 | 8.22 |
| 9-29 | I | 0.30 | 13.23 | 8.23 |
| 9-30 | L | 0.20–0.60 | 29.78 | VERY HIGH |
| 9-31 | M | 0.20–0.60 | NO SILICA FLOAT | |

TABLE X

The Effect Of Monoepoxide Adducts Of DETA, Teta And EPTA Ketimines On Flotation Of Silicates From Unsized Phosphate Ore Feeds, Using 4 Drops Of D-250 As Frother And 0.2 LB/T Of Each Collector In Each Flotation

| TEST | REAGENT DOSAGES - LB/T | | | | | |
|---|---|---|---|---|---|---|
| | ROUGHING | | COARSE | | COMB. CONCS. | |
| NO. | F.O. #2 | COLLECTOR | F.O. #2 | COLLECTOR | WT % | % INSOL |
| 10-1 | 0.375 | A | 0.50 | A | 20.61 | 3.55 |
| 10-2 | 0.375 | H | 0.50 | H | 21.77 | 6.77 |
| 10-3 | 0.375 | I | 0.50 | I | 22.83 | 6.94 |
| 10-4 | 0.375 | G | 0.50 | G | 22.10 | 7.28 |
| 10-5 | 0.375 | J | 0.50 | J | 20.94 | 5.51 |

In Table IX*b*, results as to insol content only are shown for a study of the effect of carbon chain length of monoepoxide DETA ketimine reaction products on flotation of silicates from unsized feeds, using single stage roughing only according to the flow diagram of FIG. 2, the ore sample being similar to that of Example 5, with no desliming required. These three collectors were used in combination with 4 drops of MIBC (methyl isobutyl carbinol) as frother, at two levels of collector addition, 0.2 pound per ton and 0.25 pound per ton. As can be seen in Table IX*b*, particularly referring to the right-hand column therein, increasing the chain length of the monoepoxide from $C_{11-14}$ to $C_{13-16}$ and then to $C_{20}$ did not improve the ability of a DETA ketimine adduct to selectively float the coarse silica particles from phosphate particles.

In Table IX*c*, the results are shown of a study comparing four collectors used with 1.50 pounds per ton fuel oil #2 as conditioner and a uniform amount of D-250 as frother. These collectors vary as their amine structures. They were tested by flotation of silicates from unsized phosphate ore feeds, using single stage roughing only according to the flow diagram in FIG. 2, the ore sample being similar to Example 5, with no desliming required.

These results indicate that the epoxide amine adducts are superior to other amine structures.

EXAMPLE 10

In this example, the ore and procedure used in Example 4 were used with various monoepoxide-polyamine adducts.

The flotation effectiveness of these adducts during roughing and coarse flotation of silicates from unsized phosphate ore feeds, based on the flow diagram of FIG. 2, is shown in Table X, with respect to results for insol only. In each flotation, 4 drops of D-250 as frother and 0.2 pound per ton of each collector were used.

Because it will be readily apparent to those skilled in the art that ennumerable variations, modifications, applications, and extensions of the examples and principles hereinbefore set forth can be made without departing from the spirit and scope of the invention, what is herein defined as such scope and is desired to be protected should be measured, and the invention should be limited, only by the following claims.

What is claimed is:

1. A process for recovering phosphate values from deslimed phosphate ore, containing bone phosphate of lime and passing a 14 mesh screen, that comprises the following steps for treating said ore: conditioning with a fuel oil, treating with a polyamine cationic collector and a frother, and frothing with air to remove silica particles from said ore in at least two floats having no pH adjustment step, no scrubbing step, and no oil removal step therebetween, said ore being recovered as at least two concentrate products containing at least 80% of said bone phosphate of lime and having insol values no greater than about 6% wherein said cationic collector is a composition which corresponds to the formula:

$$NH_2\text{-}(CH_2\text{-}CH_2\text{-}\overset{\overset{R}{|}}{N})_n\text{-}CH_2\text{-}CH_2\text{-}NH_2$$

where R is an aliphatic substituent containing between about 8–24 carbon atoms and between about 1–3 oxygen atoms and is derived from a monoepoxide, n is the integer 1 or 2, and one of the R substituents can be hydrogen when n is 2.

2. The process of claim 1, wherein the monoepoxide contains one 1,2-epoxide group per molecule and no other groups which are reactive with amine groups and contains about 8 to about 24 carbon atoms per molecule and is selected from the group consisting of epoxidized hydrocarbons, epoxidized unsaturated fatty esters, monoglycidyl ethers of aliphatic alcohols and monoglycidyl esters of monocarboxylic acids.

3. The process of claim 1 wherein the monoepoxide is a monoglycidyl ether of a fatty alcohol which alcohol contains 5 to 21 atoms.

4. The process of claim 1 wherein the monoepoxide is a momoglycidyl ether of a fatty alcohol which alcohol contains about 12 to about 14 carbon atoms and n is 1.

5. The process of claim 1 wherein at least about 0.5 pound of a fuel oil is used per ton of said ore.

6. The process of claim 5, wherein said fuel oil is No. 2 fuel oil.

7. The process of claim 6, wherein at least 0.2 pound of said cationic collector is used per ton of said ore with about 0.5 pound of said fuel oil per ton of said ore.

8. The process of claim 7, wherein a polypropylene glycol ether is added to said ore as a frother therefor.

9. A process for the recovery of phosphate values from an unground ore which is formed into a slurry having about 14/150 mesh particles, comprising at least two floats and further comprising the following steps:

A. conditioning said particles by adding fuel oil to said slurry before each said float; and B. adding to said slurry before each said float a frothing agent and a polyamine cationic collector corresponding to the formula:

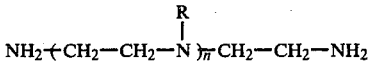

where R is an aliphatic substituent containing between about 8–24 atoms and between about 1–3 oxygen atoms and is derived from a monoepoxide, n is the integer 1 or 2, and one of the R substituents can be hydrogen when n is 2.

10. The process of claim 9, wherein the monoepoxide contains one 1,2-epoxide group per molecule and no other groups which are reactive with amine groups and contains about 8 to about 24 carbon atoms per molecule and is selected from the group consisting of epoxidized hydrocarbons, epoxidized unsaturated fatty esters, monoglycidyl ethers of aliphatic alcohols and monoglycidyl esters of monocarboxylic acids.

11. The process of claim 9, wherein said frothing agent is selected from the group consisting of isobutyl carbinol and polypropylene glycol ethers.

12. The process of claim 9, wherein no treatment step with a mineral acid is used between any of said at least two floats.

13. The process of claim 9, wherein no pH adjustment is performed.

14. The process of claim 13, wherein said collector is added at about 0.15–0.55 pound per ton of said ore.

15. The process of claim 14, wherein said slurry is screened to form a coarse fraction having about 14/35 mesh particles and a fine fraction having about 35/150 mesh particles before any of said floats are performed.

16. The process of claim 15, wherein said coarse fraction is conditioned for 15–20 seconds with about 0.2–1.5 pounds of said fuel oil per ton of said ore, treated with said cationic collector and said frothing agent, and mixed with air to create a rougher flotation which produces a phosphate concentrate, as a rougher sink, and a silica froth, as a rougher tails.

17. The process of claim 16, wherein said silica froth is subjected to cleaner and recleaner floats, without addition of any other additives than air, to produce a recleaner tail, as waste, and a combined cleaner and recleaner sink containing coarser silica and fine phosphate particles.

18. The process of claim 17, wherein said combined cleaner and recleaner sink is screened through a 48 mesh screen to produce a +48 mesh tail, as waste, and a −48 mesh concentrate, as a first product.

19. The process of claim 18, wherein said rougher sink, containing coarse and fine phosphate particles and coarse silica particles, is screened through a 35 mesh screen to produce a 35/150 concentrate as a second product and a 14/35 fraction which is conditioned at 60–70% solids with said fuel oil at 0.2–0.5 pound of fuel oil per ton of ore, treated with said collector, and mixed with air to create a coarse float which produces a tail, as waste, and a coarse concentrate, as a third product.

20. The process of claim 19 wherein:

A. said first product contains by weight at least about 5% of said ore and no more than about 4% insol;

B. said second product contains by weight at least about 10% of said ore and no more than about 6% insol; and C. said third product contains by weight at least about 4% of said ore and no more than about 10% insol; whereby said first, second, and third products form a combined concentrate which is 15–25% by weight of said ore and contains less than 6% insol at a total recovery of 75–85%.

* * * * *

UNITED STATES PATENT OFFICE

CERTIFICATE OF CORRECTION

PATENT NO. : 4,227,996

DATED : October 14, 1980

INVENTOR(S) : Nathan M. Levine et al

It is certified that error appears in the above-identified patent and that said Letters Patent are hereby corrected as shown below:

Column 2, line 61 delete "current" and insert --currently--
Column 4, line 28 delete "accid" and insert --acid--
Column 11, line 35 delete "unisized" and insert --unsized--
Column 21, line 12 insert --carbon-- before "atoms"

Signed and Sealed this

*Thirteenth* Day of *January 1981*

[SEAL]

*Attest:*

SIDNEY A. DIAMOND

*Attesting Officer*

*Commissioner of Patents and Trademarks*